United States Patent [19]

Thomas et al.

[11] Patent Number: 4,682,837

[45] Date of Patent: Jul. 28, 1987

[54] EIGHT CONDUCTOR MODULAR PLUG

[75] Inventors: Stephen M. Thomas, Torrington; Ronald Nitowski, Naugatuck, both of Conn.

[73] Assignee: The Siemon Company, Watertown, Conn.

[21] Appl. No.: 799,781

[22] Filed: Nov. 20, 1985

Related U.S. Application Data

[63] Continuation of Ser. No. 634,818, Jul. 26, 1984, abandoned.

[51] Int. Cl.[4] ..... H01R 13/639

[52] U.S. Cl. ..... 439/344

[58] Field of Search ..... 339/176 M, 32 R, 32 M, 339/33, 91 R, 195 A, 196 A, 154 A, 155 R, 156 R, 166 R

[56] References Cited

U.S. PATENT DOCUMENTS

| | | | |
|---|---|---|---|
| T961,003 | 8/1977 | Krumreich | 339/176 M |
| 4,224,485 | 9/1980 | Krumreich | 339/176 M |
| 4,241,974 | 12/1980 | Hardesty | 339/176 M |
| 4,373,766 | 2/1983 | Johnston | 339/176 M |

FOREIGN PATENT DOCUMENTS

| | | | |
|---|---|---|---|
| 555601 | 7/1923 | France | 339/154 A |

*Primary Examiner*—John McQuade

*Attorney, Agent, or Firm*—Fishman & Dionne

[57] ABSTRACT

An eight wire modular plug capable of insertion into any 6 or 8 wire modular jack is presented. The modular plug comprises eight conductive contacts, each conductive contact respectively attached to a wire leading therefrom, all of which is encased in an insulating housing. The eight wire modular plug housing has a streamlined configuration which permits entry thereof into any 6 or 8 wire modular jack. Thus, the eight wire modular plug provides access to a 6 or 8 wire jack for use with a variety of equipment in the telephonic and related industries.

2 Claims, 8 Drawing Figures

EIGHT CONDUCTOR MODULAR PLUG

This application is a continuation of application Ser. No. 634,818, filed July 26, 1984, and now abandoned.

BACKGROUND OF THE INVENTION

This invention relates to a modular plug for use in the telephonic and related industries. More particularly, this invention relates to a new and improved eight wire modular plug which can be used interchangeably on any 6 or 8 wire modular jack. The eight wire modular plug of the present invention thus provides access to a 6 or 8 wire jack for hooking up a variety of well known telephone and similar equipment.

In the telephonic and related arts, modular jacks and corresponding modular plugs are well known and have been increasingly utilized for effecting communication between telephonic and other equipment. It is also well known that modular plugs for eight wire jacks differ in size from six wire modular plugs. Modular plugs for eight wire jacks are larger than six wire modular plugs and therefore, eight wire modular plugs cannot be used in conjunction with six wire modular jack (it will be appreciated that six or eight wire modular jacks may have one or two pairs, i.e., be 2 or 4 wire). As a result, different prior art modular plugs have had to be used depending upon the modular jack which is to be interfaced (i.e., six wire plug, eight wire plug, etc.). This has created extra purchasing and manufacturing costs as well as complicating repair and installation activity.

SUMMARY OF THE INVENTION

The above discussed and other problems of the prior art are overcome or alleviated by the modular plug of the present invention. In accordance with the present invention, a novel "universal" eight wire modular plug is presented which is capable of interfacing or plugging into any six or eight wire modular jack. It will be understood that a 6 or 8 wire modular jack may have 1 or 2 pairs, i.e., be 2 or 4 wires. The novel eight wire modular plug disclosed herein which can fit into any six or eight wire modular jack is suitable for use on a variety of telephonic and related equipment including, for example, a modular plug ended test adapter such as disclosed in U.S. patent application Ser. No. 634,817, now U.S. Pat. No. 4,620,765 filed contemporaneously with the present invention, assigned to the assignee hereof and incorporated herein by reference. Many other suitable applications of the present invention will be apparent to those skilled in the art.

The modular plug of the present invention comprises eight conductive contacts, each contact respectively attached to a wire or lead. The contacts and attached wires are all encased in an insulating housing having a well known snap lock lever thereon for locking into a conventional six or eight wire modular jack. In accordance with the present invention, the eight wire modular plug housing has a relatively narrower configuration at one end thereof which permits entry into any six or eight wire modular jack. This streamlined configuration of the present invention has heretofore not been found in the prior art.

The modular plug of the present invention, therefore, provides increased versitility and capabilities relative to prior art modular plugs. Accordingly, as the present invention permits the use of only one modular plug for both six or eight wire jacks, great cost savings and ease of use are achieved thereby.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several figures.

DESCRIPTION OF THE PREFERRED EMBODIMENT

Figure 1:
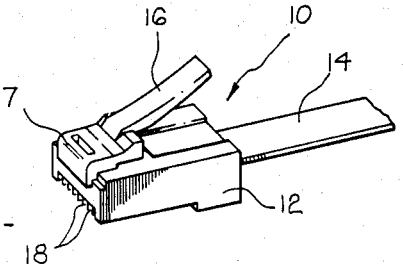
Fig. 1. PRIOR ART
FIG. 1 is a perspective view of an eight wire modular plug in accordance with the prior art.

Referring first to FIG. 1, an eight wire modular plug in accordance with the prior art is shown generally at 10. Modular plug 10 is comprised of a housing 12 connected to a lead 14. Nose portion 17 of plug 10 has attached thereto a conventional snap lock lever 16 which provides firm locking engagement to a suitable eight wire modular jack (not shown). Eight (8) contacts 18 are provided at the leading edge of housing 12 and connect to corresponding contacts in an eight wire jack. Each contact 18 is respectively connected to one of eight wires (not shown) which are provided within the housing 12 and are encased in the insulating lead 14.

While suitable for its intended applications, the known eight wire plug 12 of FIG. 1 suffers from certain above described drawbacks including the fact that it can only cooperate with and be engaged to an eight wire modular jack. This obviously diminishes the utility and versatility of the prior art plug 10.

Figure 2:
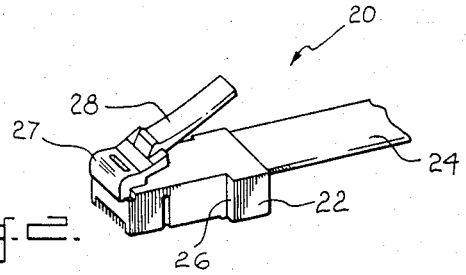
FIG. 2 is a perspective view of an eight wire modular plug in accordance with the present invention.
Figure 3:
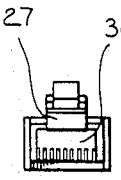
FIG. 3 is a front view of the modular plug of FIG. 2.
Figure 4:
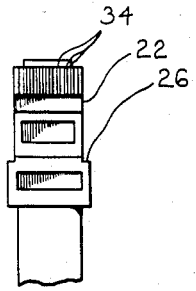
FIG. 4 is a bottom view of the modular plug of FIG. 2.

The above described problems of the prior art are overcome by the novel eight wire modular plug of the present invention shown generally at 20 in FIGS. 2–4. Like prior art modular plug 10, modular plug 20 is comprised of a housing 22 and is connected to an insulating lead 24. However, unlike plug 10, housing 22 of the novel eight wire modular jack 20 has been modified so that it is capable of fitting into any six or eight wire modular jack. As mentioned, it will be understood that a six or eight wire modular jack may have 1 or 2 pairs, i.e., be 2 or 4 wires. This novel and distinguishing feature is effected by providing stepped in side portions 26 to nose portion 27 of housing 22. Accordingly, nose portion 27 will be the same width for any 6 or 8 wire modular jack.

It is important that stepped in side portions 26 be the same size on either side of housing 12 so as to permit proper mechanical and electrical connection between a modular jack and the modular plug of the instant invention. Thus, unlike a conventional eight wire modular plug 12, which has a wider nose portion relative to six wire plugs, the novel eight wire plug of the present invention has universal sizing for any six or eight wire applications.

Other portions of the eight wire plug of the present invention are very similar to, if not identical with the prior art plug 10 of FIG. 1. Thus, modular plug 22 is provided with a conventional snap lock lever 28 for locking engagement to either a six or eight wire modular jack (not shown).

Figure 5:
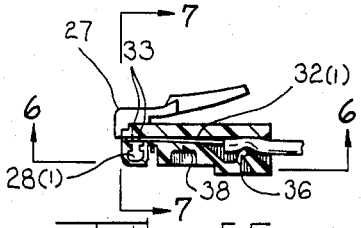
FIG. 5 is a cross-sectional elevation view of the modular plug of FIG. 2 along the line 5—5 of FIG. 3.

With reference now to FIGS. 3–7, the interior of modular plug 20 is also similar, if not identical to the interior of prior art eight wire plugs. Accordingly, eight contacts 28(1)–28(8) are provided at the front face 30 of housing 22, each contact being connected to a corresponding wire 32(1)–32(8). Housing 22 has eight apertures 34 which provide access between the contacts 28 of plug 20 and corresponding contacts of a six or eight wire modular jack (not shown). With reference to FIG. 5, note that each contact 28 has a relatively large base section terminating at aperture 34 and extending upwardly through a narrower portion wherein electrical and mechanical contact with a wire conductor 32 is effected. This electrical and mechanical contact between the contact 28 and wire 32' is provided by two needle like prongs 33 which extend from a contact into a selected wire.

Housing 22 is typically comprised of an insulative plastic material and is generally one piece molded. Retaining means are provided in the molded housing 22 so as to firmly engage the contacts 28, the wires 32, and the lead 14. Thus, a plastic protrusion 36 is integrally molded into housing 22 to support and retain lead 14 (See figures). Similarly, a molded support 38 engages and supports the eight wire conductors 32 within the interior of the housing 22. Finally, referring to FIG. 6, a plurality of finger like projections 40 are provided in the front face 30 of housing 22 so as to retain, space apart, and electrically insulate both the contacts 28 and the wire conductors 32.

Figure 8:
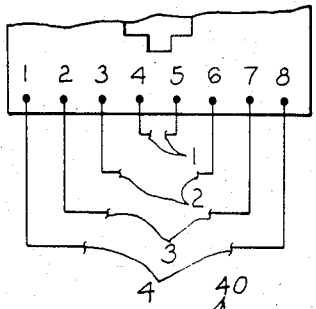
FIG. 8 is a schematic view showing a preferred wiring configuration of the modular plug in accordance with the present invention.
Figure 7:
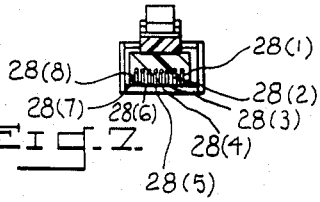
FIG. 7 is a cross-sectional elevation view of the modular plug of FIG. 2 along the line 7—7 of FIG. 5.
Figure 6:
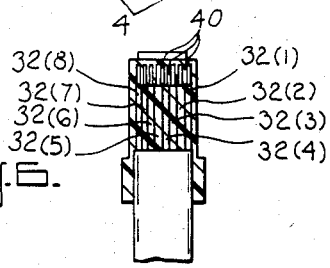
FIG. 6 is a cross-sectional elevation view of the modular plug of FIG. 2 along the line 6—6 of FIG. 5.

As mentioned, the eight wire modular plug 20 of the present invention will fit into any six or eight wire modular jack and provide access to the jack for a plurality of well known telephonic and related equipment. In FIG. 8, a schematic depiction of pair numbers of wire conductors is shown. Accordingly, wires 32(4) and 32(5) which are connected to contacts 28(4) and 28(5) comprise a first pair number 1. Similarly, wires 32(3) and 32(6) which are connected to contacts 28(3) and 28(6), respectively, comprise pair number 2. In the same regard, wires 32(2) and 32(7) form pair number 3 while wires 32(1) and 32(8) form pair number 4. It will be appreciated that each pair number of wires and contacts form an individual circuit after connection with a conventional eight wire modular jack.

As discussed, the novel modular plug 20 of the present invention can also fit into a six wire modular jack. In that case, pair number 4 in FIG. 8 corresponding to wire conductors 32(1) and 32(8) and contacts 28(1) and 28(8) will normally be inoperable. Accordingly, in the case of a six wire modular jack, only three pair numbers (i.e., pairs 1–3) will be electrically actuated when using a six wire modular jack. However, in some applications, six or eight wire modular jacks may include only one or two pairs. In those cases, only two pair numbers (i.e., pairs 1 and 2) or one pair number (i.e., pair 1) of the plug will be electrically actuated.

Thus, unlike prior art modular plugs, the eight wire modular plug of the present invention permits access thereof between an eight wire modular jack or a six wire modular jack. This important feature of the present invention leads to great cost savings in terms of manufacturing and purchasing as well as less complication for the telephonic equipment installer and/or repairer.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. In an eight position modular plug for telephonic and related equipment including an insulating housing having eight contacts therein, each contact being connected to a wire, each of said contacts and wires being substantially mutually parallel to each other throughout the insulating housing, the housing having a front face, the front face including a plurality of apertures to permit access between the eight contacts and a modular jack, the housing having an upper surface with a locking means thereon which is associated with the front face, the housing having a rear face with a unitary insulating lead extending therefrom, the unitary lead surrounding the eight wires, the improvement comprising:

means for allowing insertion of said front face of said housing into either a six or eight position modular jack, said means for allowing insertion comprising a pair of oppositely disposed stepped-in portions extending from said front face along the sides of said housing wherein at least a portion of said housing is capable of insertion into a six or eight position modular jack.

2. The plug of claim 1 wherein:

said stepped in side portions are equal in size.

* * * * *